United States Patent [19]

Stachowiak

[11] Patent Number: 4,768,933

[45] Date of Patent: Sep. 6, 1988

[54] HIGH PRESSURE RECIPROCATING PUMP AND VALVE ASSEMBLY THEREFOR

[76] Inventor: J. Edward Stachowiak, P.O. Box 79731, Houston, Tex. 77024

[21] Appl. No.: 110,182

[22] Filed: Oct. 19, 1987

[51] Int. Cl.[4] ..... F04B 39/14

[52] U.S. Cl. ..... 417/454; 417/570; 137/543.13; 137/543.23

[58] Field of Search ..... 137/543.13, 543.23; 251/361-363; 417/454, 570

[56] References Cited

U.S. PATENT DOCUMENTS

| | | | |
|---|---|---|---|
| 2,722,232 | 11/1955 | Roche | 137/543.13 X |
| 3,125,963 | 3/1964 | Whitley et al. | 417/454 X |
| 4,140,442 | 2/1979 | Mulvey | 417/454 |
| 4,239,463 | 12/1980 | Yaindl | 417/454 |
| 4,277,229 | 7/1981 | Pacht | 417/539 |
| 4,354,520 | 10/1982 | Easley | 137/543.23 |
| 4,527,961 | 7/1985 | Redwine et al. | 417/454 |
| 4,618,316 | 10/1986 | Elliott | 417/454 |

*Primary Examiner*—Carlton R. Croyle
*Assistant Examiner*—Ted Olds
*Attorney, Agent, or Firm*—Kenneth A. Roddy

[57] ABSTRACT

A high pressure reciprocating pump is disclosed comprising a cylinder block with a pump chamber into which a pump plunger is reciprocally moved. A packing gland seals the pump plunger against leakage under high pressure. The pump has an inlet manifold on one side and an outlet or discharge manifold at one end secured on said cylinder block. Valve assemblies are positioned between the cylinder block and the inlet and outlet manifolds respectively. Each valve assembly comprises a disc-shaped cylindrical seat element with a central bore and a seat. A groove in the seat end surrounds the valve seating surface. The other side of the seat disc has a guide lip surrounded by a groove receiving an O-ring seal. A hollow cylindrical retainer cage having a segmented flange at one end is releasably received in the groove surrounding the seating surface with sufficient clearance to receive an O-ring seal. The retainer cage has apertures through the sidewall providing flow passageways therethrough and an integral web portion at the end opposite the flange. A generally cylindrical valve element has a seating surface configured to seat against the valve seat and is biased against the seat by a coiled spring positioned between the underside of the web portion of the cage and the valve element. The cage, seat disc, and spring can be replaced or reused when the valve disc is replaced. A modified seat disc having identical top and bottom surfaces may be inverted and reused.

34 Claims, 2 Drawing Sheets

HIGH PRESSURE RECIPROCATING PUMP AND VALVE ASSEMBLY THEREFOR

BACKGROUND OF THE INVENTION

1. Field of the Invention

This invention relates generally to high pressure pumps, and more particularly to an improved valve assembly for high pressure reciprocating pumps.

2. Brief Description of the Prior Art

High pressure fluid delivery systems with reciprocating pumps are used to create a high pressure water jet for cleaning, or water jetting. Hydraulic pressures in excess of 10,000 psi may be present in various sections of these pumps, subjecting their parts to significant stress. The valve members in such pumps often require frequent repair or replacement due to the high pressures involved and the damage caused by impurities in the fluid being pumped.

Various types of valve assemblies have been used in high pressure reciprocating pumps including: (1) valve assemblies utilizing seats that are press-fitted into the pump fluid end cylinder body; (2) valve assemblies utilizing seats which are seated and retained in the pump fluid end cylinder body by means of a locking and sealing taper on the seat, such as shown by Elliott in U.S. Pat. No. 3,474,808; (3) valve assemblies utilizing tubular seats with circumferential O-ring seals which are inserted in cylindrical bores in the cylinder body, such as shown by Pacht in U.S. Pat. No. 4,277,229; and (4) disc seat style valve assemblies that are retained and sealed in the pump fluid end by being clamped between the cylinder body and manifolds that conduct the suction and discharge fluid to the cylinder body.

Several types of clamped disc seat style valve assemblies currently being used in high pressure reciprocating pumps utilize a spring cage which is integral with the seat disc. A press-fitted seat insert is utilized in this style but it has the same disadvantages as a press-fitted seat in the cylinder body in that any high pressure fluid that may bypass the insert causes erosion damage to the insert bore in the seat disc. The press-fitted seat insert in this style also has the disadvantage of requiring special tools for its replacement in the valve assembly. Another type of clamped disc seat style valve assembly currently in use is one in which the seat disc is "sandwiched" to a flange on the spring cage that is of the same diameter as that of the seat disc. This valve assembly is more expensive to manufacture than the disclosed valve assembly due to its unnecessarily large spring cage flange. It also has the disadvantage of requiring an additional high pressure seal to seal the mating faces between the spring cage flange and the sandwiched seat disc.

Mulvey, U.S. Pat. No. 4,140,442 discloses a valve assembly wherein an apertured cup-shaped valve housing having a flanged lower rim is pressed fitted within a stepped wall of the valve seat member to form an integral valve assembly. When the valve assembly is positioned in the port, a pair of O-rings are positioned on top and beneath the valve assembly.

Yaindl, U.S. Pat. No. 4,239,463 discloses a valve assembly in which the spring cage is retained in a circular bore by means of a snap ring.

Pangburn, U.S. Pat. No. 3,277,837 discloses a valve assembly having a plurality of segmented wedges or levers which are fulcrumed against a cylindrical plug at the cylinder head openings.

The present invention is distinguished over the prior art in general, and the above patents in particular by a valve assembly having a reusable spring cage that snaps onto a disposable seat disc. The valve and spring can be replaced or reused when the valve disc is replaced. The snap-type attachment of the spring cage to the seat disc allows the valve assembly to be handled and installed and removed from the pump fluid end as a one-piece assembly. A small flange on the spring cage where it snap attaches to the seat disc allows the spring cage to be securely clamped to the seat disc by the cylinder body and manifold when the valve assembly is installed in the pump fluid end. A modified seat disc having identical top and bottom surfaces may be inverted and reused.

SUMMARY OF THE INVENTION

It is therefore an object of the present invention to provide a high pressure reciprocating pump having a valve assembly which is clamped between the cylinder body and manifolds and does not require special tools or pullers for replacement in the pump fluid end.

It is another object of this invention to provide a high pressure reciprocating pump having a valve assembly wherein the valve seat seals are external to the fluid pump end thereby allowing leakage from the seals to be quickly and easily detected by the pump operator.

Another object of this invention is to provide a high pressure reciprocating pump having a valve assembly which eliminates the necessity of machining costly, close tolerances and high finished bores in the pump cylinder body.

Another object of this invention is to provide a high pressure reciprocating pump having a valve assembly which features a reusable spring cage that snaps onto a disposable seat disc which allows the valve and spring to be replaced or reused when the valve disc is replaced.

Another object of this invention is to provide a high pressure reciprocating pump with a valve assembly having a snap-type attachment of the spring cage to the seat disc which allows the valve assembly to be handled and installed and removed from the pump fluid end as a one-piece assembly.

Another object of this invention is to provide a high pressure reciprocating pump having a valve assembly wherein the spring cage has a small flange which snap attaches to the seat disc thereby allowing the spring cage to be securely clamped to the seat disc by the cylinder body and manifold when the valve assembly is installed in the fluid end.

Another object of this invention is to provide a valve assembly for high pressure reciprocating pumps which features a seat disc having a seating surface at each end which allows the seat disc to be inverted and reused when one of the seating surfaces becomes unusable.

A further object of this invention is to provide a valve assembly for high pressure reciprocating pumps which requires fewer high pressure seals for its operation than most existing valve assemblies.

A still further object of this invention is to provide a valve assembly for high pressure reciprocating pumps which is simple in design and operation, inexpensive to manufacture, and rugged and durable in use.

Other objects of the invention will become apparent from time to time throughout the specification and claims as hereinafter related.

The above noted objects and other objects of the invention are accomplished by the present valve assembly having a reusable spring cage that snaps onto a disposable seat disc. The valve and spring can be replaced or reused when the valve disc is replaced. The snap-type attachment of the spring cage to the seat disc allows the valve assembly to be handled and installed and removed from the pump fluid end as a one-piece assembly. A small flange on the spring cage where it snap attaches to the seat disc allows the spring cage to be securely clamped to the seat disc by the cylinder body and manifold when the valve assembly is installed in the pump fluid end. A modified seat disc having identical top and bottom surfaces may be inverted and reused.

DESCRIPTION OF THE PREFERRED EMBODIMENT

Figure 1:
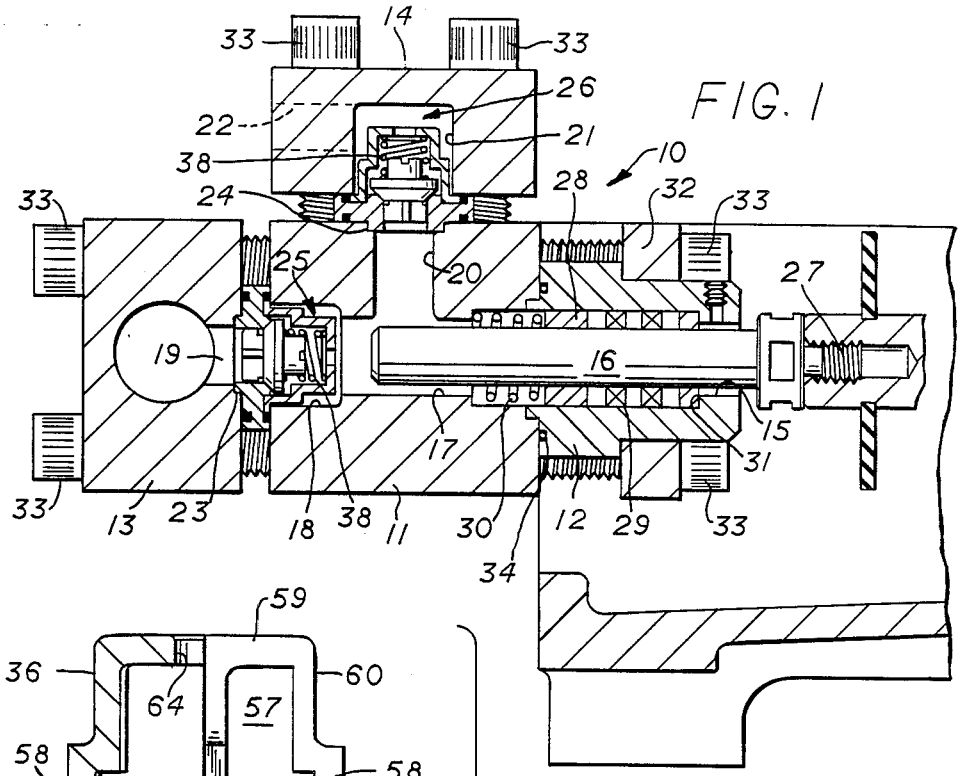
FIG. 1 is a longitudinal cross section of a portion of a high pressure reciprocating pump containing a valve assembly in accordance with the present invention.
Figure 2:
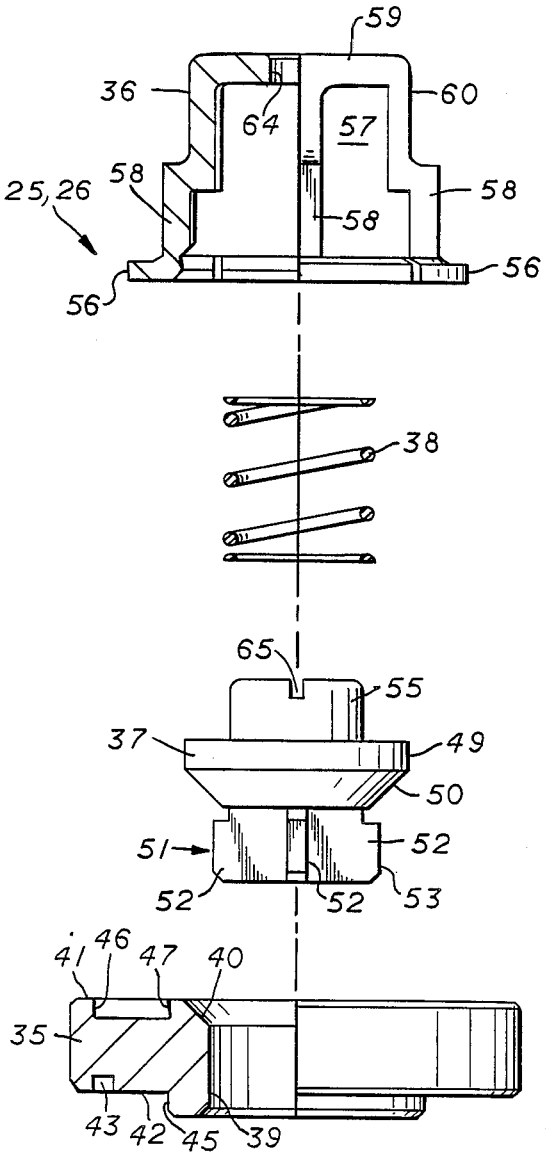
FIG. 2 is an exploded elevation of the components of the valve assembly of FIG. 1, some of which are cross sectioned.
Figure 4:
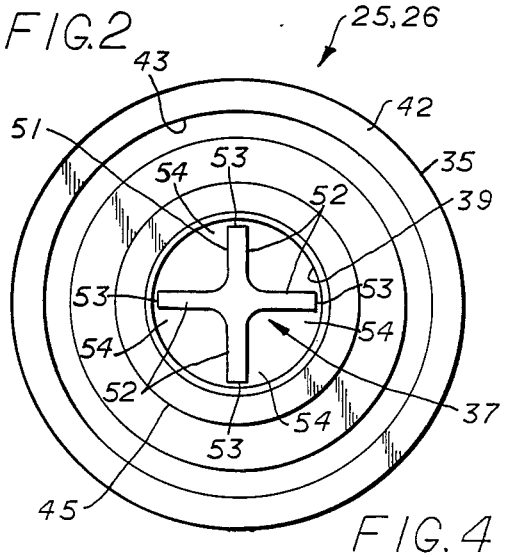
FIG. 4 is a bottom plan view of the valve assembly in the assembled condition.
Figure 3:
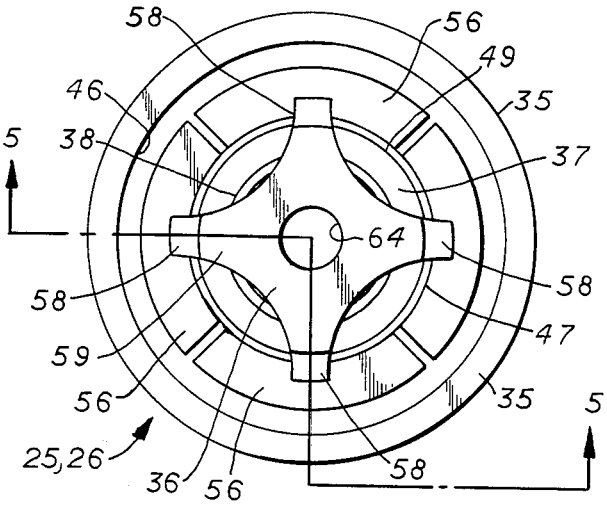
FIG. 3 is a top plan view of the valve assembly in the assembled condition.

Referring to the drawings by numerals of reference, there is shown in FIG. 1, the internal construction of the fluid end of a high pressure reciprocating pump 10 having a valve assembly according to the invention. The pump assembly includes a fluid cylinder block 11 with a stuffing box 12 mounted at one side thereof, a suction manifold 13 mounted at the other side and a discharge manifold 14 mounted on an outer wall of the cylinder block. A cylindrical bore 15 in the stuffing box holds a piston or plunger 16 sliding toward the cylinder block. A cylindrical passage 17 extends through the fluid cylinder block and forms a pump chamber receiving one end of plunger 16. A counterbore 18, of larger diameter than the passage 17, extends inwardly a distance from the suction manifold side of the fluid cylinder block 11. The suction manifold 13 has a suction port 19 in axial alignment with and forming the outlet to the passage 17 of the fluid cylinder block.

A cylindrical outlet or discharge passage 20 extends perpendicular to pump chamber 17, from the passage 17 to an outer end wall of the fluid cylinder block 11. A cylindrical bore 21, having a diameter larger than the passage 19 and approximately the same diameter as counterbore 18, extends a distance inwardly into the discharge manifold 14. A discharge port 22 in communication with the bore 20 directs fluid from the discharge manifold 14. The suction port 19 of suction manifold 13 has a counterbore 23 and the passage 20 of cylinder body 11 has a counterbore 24.

A suction valve assembly 25 is clamped between the fluid cylinder block 11 and the suction manifold 13 in axial alignment between the suction port 19 and the passage 17. A discharge valve assembly 26 is clamped between the fluid cylinder block 11 and the discharge manifold 14 in axial alignment with the manifold bore 21 and the passage 20.

When the plunger 16 is moved away from the fluid cylinder block 11, the discharge valve assembly 24 is closed and fluid is drawn from the suction port 19 through the suction valve assembly 25. When the plunger 16 is moved toward the fluid cylinder block 11, the suction valve assembly 25 is closed, and fluid is driven through the discharge valve assembly 26 into the discharge port 22.

The suction and discharge valve assemblies 25 and 26 are identical in construction and are positioned in opposing operative directions relative to the cylinder block 11. The components of the valve assemblies will be assigned the same numerals of reference in the detailed description which follows hereinafter.

In the operation of pump 10, the motion of the plunger 16 draws fluid from the suction manifold 14 and forces it into the discharge port 22. It should be understood that the pump 10 may have several plungers 16, side by side, each with its associated valves 25 and 26 of the type shown in Fig.1. The operations of the plungers are combined by connecting to force water into one common discharge port 22.

Having thus briefly described the major components of the fluid end of the reciprocating valve 10, a more detailed description follows.

Plunger 16 has a threaded connector 27 for connection to a driving source (not shown) which reciprocates the plunger along the longitudinal axis thereof. Plunger 16 moves in bore 15 of stuffing box 14, in contact with bushing 28 and packing assembly 29. Packing 29 is compressed by packing spring 30 pressing on the bushing 28. Packing 29 is held in place by the bushing 28 and an internal shoulder 31 in the stuffing box 12. Lubrication may be provided to the plunger through the packing in a conventional manner.

Stuffing box 14 is mounted with one end against the side of the fluid cylinder block 11. Adapting plate 32 bears against an enlarged diameter at one end of the stuffing box 12. Cap screws 33 pass through adapting plate 32 and are screwed into fluid cylinder block 11, to hold stuffing box 12 in place. A ring seal 34 seals around the passage 17 at the interface of stuffing box 12 and fluid cylinder block 11. The suction manifold 13 and the discharge manifold 14 are held in place by cap screws 33 fastened into cylinder 11.

As shown in FIGS. 2, 3, 4 and 5, the suction valve assembly 25 and discharge valve assembly 26 each comprise a cylindrical seat disc element 35, a spring cage element 36, a valve element 37, and a coiled compression spring 38.

Figure 5:
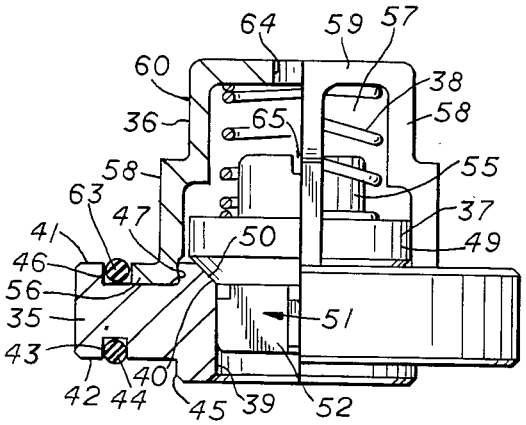
FIG. 5 is a front elevation view of the valve assembly shown in partial cross section taken along line 5—5 of FIG. 3.

The seat disc element 35 is a flange-like disc having a central bore 39 and an inwardly tapered, truncated conical seating surface 40 at one end. The ends 41 and 42 of the seat disc are perpendicular to the axis of the central bore 39. The bore 39 serves as a guide for the valve element 37 which is positioned therein as shown in FIG. 5. An O-ring groove 43 is provided on one end 42 of the seat disc 35 and receives an O-ring seal 44. When installed as a suction valve, the O-ring seal 44 forms a fluid seal around the suction port 19 on the outer surface of the suction manifold 13. When installed as a discharge valve, the O-ring seal 44 forms a fluid seal around the passage 20 on the outer surface of the cylinder block 11.

A reduced diameter portion of the seat disc end 42 defines a raised guide lip 45 which is received in the counterbore 23 or 24 depending upon whether the valve assembly is installed as a suction valve or discharge valve.

Figure 6:
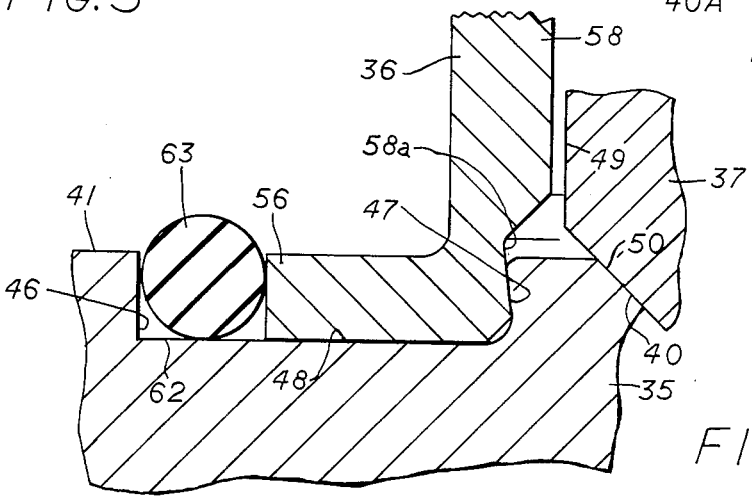
FIG. 6 is an enlarged detail of a portion of the valve assembly of FIG. 5 showing the snap fit connection of the cage member with the valve seat disc member.

The other end 41 of the seat disc 35 is recessed a short distance to form a groove having a short cylindrical wall 46 of a first diameter and a concentric raised shoulder 47 which surrounds the tapered seating surface 40 and is of smaller diameter than the wall 46. As best seen in FIG. 6, the raised shoulder 47 tapers angularly upward and outward from the flat surface 48 of the recessed portion to form a continuous peripheral undercut surrounding the seating surface.

The valve element 37 is defined by an enlarged diameter cylindrical portion 49 having a truncated conical seating portion 50 to engage the truncated conical interior seating surface 40 of the seat disc 35 in a sealing relationship as shown in FIG. 5. It should be understood that the angle of these tapered sealing surfaces is sufficient for the pressures employed to issue proper seating and reduce the forces required to move the valve members to and from their sealing positions. A first reduced diameter guide portion 51 extends from the conical seating portion 50 to be slidably received in the seat disc bore 39.

In the preferred embodiment illustrated in FIGS. 1–5, the guide portion 51 comprises at least three (four are shown in the illustrated embodiment) integral wing portions 52 which extend radially about the valve element axis. The outer edge 53 of the wing portions 52 generate a cylinder of a diameter less than the diameter of the seat disc bore 39 and provide fluid flow paths 54 therebetween. A second reduced diameter portion 55 extends from the enlarged diameter 39 at the end opposite the guide portion 51.

The reusable spring cage element 36 comprises a hollow cylindrical cup shaped member having a flat segmented flange 56 extending radially outward perpendicular to the spring cage axis at one end. The thickness of the flange 56 is approximately the same as the depth of the wall 46 of the seat disc 35. The sidewall of the cage 36 has relatively large apertures 57 which define integral leg portions 58 that extend radially about the cage element axis. The outer edge of the leg portions 58 generate a cylinder of a diameter less than the counterbore 18 of the cylinder body 11 and the bore 21 of the discharge manifold 14 to provide fluid flow paths therebetween. A web portion 59 integrally connects the leg portions 58 opposite the flanged end 56. The sidewall of the cage 36 has a reduced diameter portion 60 near the web end to provide a less restricted annular fluid flow path.

As best seen in FIG. 6, the lower interior diameter **58*a* of the spring cage flange 56 tapers angularly upward and outward at substantially the same angle as the angle of the raised shoulder 47 but at a slightly less radial dimension to form a peripheral bead which provides an interference fit therewith. Thus the cage 36 is installed on the raised shoulder 47 of the seat disc 34** by placing it on the top of the shoulder and pressing it downward until it snaps securely over the shoulder.

Once the cage 36 has been snapped into position on the shoulder 47, the outer circumference of the flange 56 is spaced radially inward from the wall 46 of the seat disc 35 to define a groove 62 therebetween which receives an O-ring seal 63. It should be noted, that in the installed position, the flange 56 on the spring cage 35 is securely clamped to the seat disc 35 by the cylinder body 11 or the discharge manifold 14 when the valve assembly is installed in the fluid end.

When installed as a suction valve, the O-ring seal 63 forms a fluid seal on the cylinder body 11 around the counterbore 18. When installed as a discharge valve, the O-ring seal 63 forms a fluid seal around the bore 21 on the outer surface of discharge manifold 14.

The coil spring 38 is positioned concentrically within the cage element 36 and around the reduced diameter portion 55 of the valve element 37. The spring 38 is compressed between the underside of the web 59 and the top surface of the enlarged diameter 49 of the valve element 37. The spring 38 functions to urge the valve element 37 toward the closed position, the force of the spring being overcome in operation by fluid pressure permitting the valve to open as fluid is through the valve by the reciprocating pump in which the valve is used.

In order to facilitate valve repair or removal operations, the web 59 has a central vertical bore 64 of suitable diameter to receive a screwdriver or other appropriate tool. The top end of the second guide portion 55 of the valve element 37 has a transverse slot 65 of sufficient size to receive end of the screwdriver or other tool. The seating portion 50 of the valve element may be lapped or hand ground to seating surface 40 of the seat disc by insertion of a screwdriver through the bore 64 in the web and into the slot 65 and, with lapping or grinding abrasive compound present between the surfaces, turning the screwdriver in a reciprocating rotational motion until the seating surfaces become lapped or hand ground to each other.

The valve and spring in this invention can be replaced or reused when the valve disc is replaced. The snap-type attachment of the spring cage to the seat disc allows the valve assembly to be handled and installed and removed from the pump fluid end as a one-piece assembly. The small flange on the spring cage where it snap attaches to the seat disc allows the spring cage to be securely clamped to the seat disc by the cylinder body and manifold when the valve assembly is installed in the fluid end.

Figure 7:
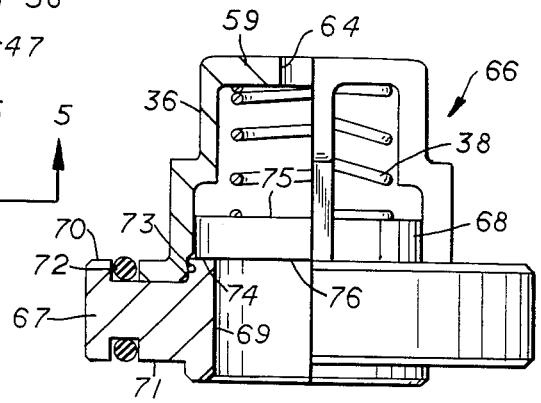
FIG. 7 is an elevation view in partial cross section of an alternate valve assembly having a flat reciprocating valve and valve seat arrangement.

An alternative embodiment of the clamped disc style valve assembly is shown in FIG. 7. In this embodiment, a flat disc type valve element is used. In the following description, the components previously described have the same numerals of reference and, to avoid repetition, the description of some identical components will not be repeated.

As shown in FIG. 7 valve assembly 66 comprises a modified cylindrical seat disc element 67, a spring cage element 36, a coiled compression spring 38, and a flat disc valve element 68.

The seat disc element 67 is a flange-like disc having a central bore 69 and the ends 70 and 71 of the seat disc are perpendicular to the axis of the central bore 69. One end of the seat disc 67 is recessed a short distance to form a groove having a short cylindrical wall 72 of a first diameter and a concentric angular raised shoulder 73 which forms a continuous peripheral undercut surrounding the bore 69. A top flat surface 74 of the shoulder 73 is perpendicular to the axis of the seat disc 67 and serves as the seating surface for the valve element.

The valve element 68 is a short cylindrical disc member having flat ends 75 and 76, end 76 being the seating surface to engage the flat seating surface 74 of the raised shoulder 73 in sealing relationship as shown in FIG. 7.

The coil spring 38 is positioned concentrically within the cage element 36 and is compressed between the underside of the web 59 and the top surface of the disc valve element 68.

Figure 8:
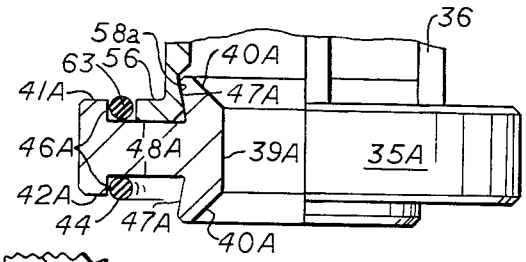
FIG. 8 is a front elevation view of a modified seat disc member shown in partial cross section.

FIG. 8 shows a modified seat disc element 35A having identical top and bottom surfaces which allows the seat disc to be inverted and reused. The seat disc element 35A is a flange-like disc having a central bore 39A and an inwardly tapered, truncated conical seating surface 40A at each end. The top and bottom ends 41A and 42A of the seat disc are perpendicular to the axis of the central bore 39A. The bore 39A serves as a guide for the valve element 37 which is positioned therein as shown in FIG. 5.

Both ends 41A and 42A of the seat disc 35A are recessed a short distance to form a groove having a short cylindrical wall 46A of a first diameter and a concentric raised shoulder 47A which surrounds the tapered seating surface 40A and is of smaller diameter than the wall 46A. As previously described with reference to FIG. 6, the raised shoulder 47A tapers angularly upward and outward from the flat surface 48A of the recessed portion to form a continuous peripheral undercut surrounding the seating surface.

As previously described with reference to FIG. 6, the lower interior diameter 58*a* of the spring cage flange 56 tapers angularly upward and outward at substantially the same angle as the angle of the raised shoulder 47A but at a slightly less radial dimension to form a peripheral bead which provides an interference fit therewith. Thus the cage 36 is installed on the raised shoulder 47A of the seat disc by placing it on the top of the shoulder and pressing it downward until it snaps securely over the shoulder.

Once the cage 36 has been snapped into position on the shoulder 47A, the outer circumference of the flange 56 is spaced radially inward from the wall 46A of the seat disc 35A to define a groove therebetween which receives an O-ring seal 63. It should be noted, that in the installed position, the flange 56 on the spring cage 35 is securely clamped to the seat disc 35A by the cylinder body 11 or the discharge manifold 14 when the valve assembly is installed in the fluid end.

When installed as a suction valve, the O-ring seal 63 forms a fluid seal on the cylinder body 11 around the counterbore 18. When installed as a discharge valve, the O-ring seal 63 forms a fluid seal around the bore 21 on the outer surface of discharge manifold 14.

Another O-ring seal 44 is installed in the recess inside the short cylindrical wall 46A. When installed as a suction valve, the O-ring seal 44 forms a fluid seal around the suction port 19 on the outer surface of the suction manifold 13. When installed as a discharge valve, the O-ring seal 44 forms a fluid seal around the passage 20 on the outer surface of the cylinder block 11.

The angular raised shoulder 47A opposite the one to which the spring cage is attached serves as a raised guide lip and is received in the counterbore 23 or 24 depending upon whether the valve assembly is installed as a suction valve or discharge valve.

When one conical seating surface 40A becomes worn or otherwise unusable, the seat disc element 35A may simply be inverted and the disc element is reused with the spring cage and other components assembled as previously described. Although the conical seating surface has been illustrated, it should be understood that the seat disc embodiment 67 of Fig. 7 having a flat disc type valve element may also be provided with identical top and bottom ends having a flat seating surface at the end of the angular raised shoulder.

OPERATION

Referring again to FIGS. 1 and 5, in the operation of the pump 10, the plunger 16 is pulled in a direction away from the fluid cylinder block 11 to draw fluid into the pump chamber. The pressures produced by this motion of the plunger tends to pull valve 25 towards the plunger, when the force exerted by spring 38 is overcome. The discharge valve 26, aided by the force of spring 38 is closed and remains so during the suction stroke, however, valve 25 opens off seat 40. Fluid is drawn from suction port 19, through the interior of valve seat disc 35 and into the bore 39 occupied by valve guide 51. Fluid flows through the valve fluid flow path 54, around the enlarged diameter 49 of valve element 37 and into passage 17 and the portion of the passage 20 vacated by the plunger 16.

When the plunger 16 is moved toward fluid cylinder block 11, the tendency of both valves 25 and 26 is to be pushed away from the plunger. Thus, suction valve 25 is pushed closed against its valve seat 40, aided by the force of spring 38. Discharge valve 26 is forced open, away from its valve seat 40 against the force of spring 38. Fluid flows from passage 17 and passage 20, through interior of seat disc 35 and the fluid flow paths 54 between the valve guide 51 and the seat disc bore 39. The fluid then flows around the legs of cage 36 of discharge valve 26, into the bore 21 of discharge manifold 14, then out through the discharge port 22.

Disc seat style valve assemblies according to the present invention which are clamped between the cylinder body and manifolds have several advantages. One advantage is that, unlike the other valve assembly styles, the clamped disc seat style does not require special tools or pullers for replacement in the fluid end. Another advantage is that the face seals on the disc seat style allow any leakage from the seals to be quickly and easily detected by the pump operator since such leaks are external to the pump fluid end. Leakage between the valve seat and the cylinder body in most other styles of valve assemblies is internal in the pump fluid end and is usually detected only after fluid erosion damage to the cylinder body from high pressure fluid by-passing the valve seat has occurred. Yet another advantage of clamped seat disc styles valve assemblies is that they can provide a high pressure pump fluid end that is less expensive to manufacture because they do not require costly close-toleranced and highly finished bores to be machined in the cylinder body. A still further advantage is provided by a valve seat disc having a valve seat at each end which may be inverted and reused to double the life of the seating surface without having to repair or replace the seat element.

The disclosed valve assembly features a reusable spring cage that snaps onto a disposable seat disc or a modified reusable seat disc having a seating surface at both ends. The valve and spring in this invention can be replaced or reused when the valve disc is replaced. The snap-type attachment of the spring cage to the seat disc allows this four-piece valve assembly to be handled and installed and removed from the pump fluid end as a one-piece assembly. A small flange on the spring cage where it snap attaches to the seat disc allows the spring cage to be securely clamped to the seat disc by the cylinder body and manifold when the valve assembly is installed in the fluid end.

The disclosed valve assembly provides operational, maintenance and lower manufacturing cost advantages over other currently used clamped disc style valve assemblies. This valve assembly requires fewer high pressure seals for its operation then the currently used types, it can be repaired and maintained without the use of special tools and its spring cage is more economical to manufacture than the spring cages on the currently used types.

While this invention has been described fully and completely with special emphasis upon a preferred embodiment, it should be understood that within the scope of the appended claims the invention may be practiced otherwise than as specifically described herein.

I claim:

1. A reciprocating pump capable of delivering fluid at relatively high pressures in excess of 5000 psi, comprising;

a fluid cylinder block having a cylindrical passage providing a pump chamber and an inlet and outlet therefrom, a stuffing box mounted against said cylinder block at one end of said pump chamber, a cylindrical plunger extending through said stuffing box into said pump chamber for reciprocal movement therein, a suction manifold mounted on said fluid cylinder block at the inlet to said pump chamber, suction valve means positioned between said said suction manifold and said fluid cylinder block permitting the fluid to flow into said pump chamber on outward movement of said plunger, a discharge manifold mounted on said fluid cylinder block at the outlet from said pump chamber, discharge valve means positioned between said said discharge manifold and said fluid cylinder block permitting the fluid to flow out of said pump chamber on inward movement of said plunger, said suction valve means and said discharge valve means being identical and interchangeable, each of said valve means comprising a disc-shaped cylindrical seat element with a central bore therethrough and a valve seat surface on at least one side and a groove in at least one side thereof surrounding said valve seat and having a cylindrical outer wall and an inner wall having a continuous peripheral undercut tapered angularly upward and outward relative to the groove, a generally cylindrical valve element configured to close against said valve seat surface, a hollow cylindrical retainer element having a circumferential flat segmented flange at one end which has a peripherally beaded portion and a web portion partially enclosing the other end thereof, said beaded portion tapered angularly upward and outward at substantially the same angle as the angle of said groove undercut whereby said retainer element may be releasably installed in said groove by pressing it downward until it snaps securely over the inner edge of said groove to fit into said undercut, and spring means positioned between an end portion of said retainer element and said valve element to bias said valve element into closed position, whereby in operation, the reciprocation of said plunger draws fluid from the suction manifold through the suction valve means and drives the fluid through the discharge valve means and into the discharge port at relatively high pressures.

2. A reciprocating pump according to claim 1 including a first sealing ring between said stuffing box and fluid cylinder block, said suction valve means being positioned with said disc shaped seat element and said flat segmented flange clamped between said suction manifold and said cylinder block, second and third sealing rings between said suction valve means and said suction manifold and said fluid cylinder block for sealing between said suction valve means and valve chamber and said suction valve means and suction manifold, said discharge valve means being positioned with said disc shaped seat element and said flat segmented flange clamped between said discharge manifold and said cylinder block, fourth and fifth sealing rings between said discharge valve means and said discharge manifold and said fluid cylinder block for sealing between said discharge valve means and valve chamber and said discharge valve means and discharge manifold.

3. A reciprocating pump according to claim 1 in which said spring means comprising a coiled spring positioned between the underside of said web portion of said retainer element and said valve element, said valve seat element having a groove in the side opposite said valve seat and surrounding said bore, one of said sealing rings being positioned in the groove in which said retainer element flange is positioned, and another of said sealing rings being positioned in said seat element opposite side.

4. A reciprocating pump according to claim 3, in which said one sealing ring positioned in the groove in which said retainer element flange is positioned is disposed between the outer edge of said segmented flange and the outer wall of the groove.

5. A reciprocating pump according to claim 1 in which said suction valve means and said discharge valve means each include;

a valve seat surface on both sides of said disc-shaped cylindrical seat element, a groove in both sides of said disc-shaped cylindrical seat element surrounding said valve seat and having a cylindrical outer wall and an inner wall having a continuous peripheral undercut, and said retainer element circumferential flat segmented flange having a peripherally beaded portion configured to clamp into said groove undercut on said seat element.

6. A reciprocating pump according to claim 1 in which said suction valve means and said discharge valve means each include;

a groove in one side of said cylindrical seat element surrounding said valve seat and having a cylindrical outer wall and an inner wall having a continuous peripheral undercut, said retainer element circumferential flat segmented flange having a peripherally beaded portion configured to clamp into said groove undercut on said seat element.

said retainer element has a web portion partially closing one end thereof, said spring means comprising a coiled spring positioned between the underside of said web portion of said retainer element and said valve element, one of said sealing rings being disposed in the groove in which said retainer element flange is positioned between the outer edge of said segmented flange and the outer wall of the groove, said valve seat element having a groove in the side opposite said valve seat and surrounding said bore, another of said sealing rings being positioned in said seat element opposite side.

7. A reciprocating pump according to claim 1 in which;

said valve seat surface of said cylindrical seat element is defined by an inwardly tapered truncated conical interior seating surface at one end of said central bore,

8. A reciprocating pump according to claim 7 in which;

said valve element has an axially symmetrical cylindrical body portion with a conical seating surface fitting said conical interior seating surface of said seat element, said conical seating surface having one reduced diameter guide portion at one end slidable in said central bore of said seat element, and another reduced diameter portion at the other end positioned within said retainer element.

9. A reciprocating pump according to claim 8 in which said coiled spring is received about said other reduced diameter portion of said seat element to normally bias said valve element into closed position.

10. A reciprocating pump according to claim 8 in which;

said one reduced diameter guide portion of said valve element comprises at least three integral wing portions extending radially about the valve element axis, the outer edge of said wing portions generating a cylinder of a diameter less than the diameter of the central bore of said seat element, the space between said radial wing portions providing fluid flow paths.

11. A reciprocating pump according to claim 8 including;

a central bore through said web portion of said retainer element for insertion of a tool suitable for rotating said valve element, a slot extending transversely across the top of said second reduced diameter portion of said valve element to receive one end the tool and transmit rotational movement of the tool to said valve element whereby the seating surfaces of said seat element and said valve element may be resurfaced without disassembly of the valve by applying abrasive material between the sealing surfaces and rotating the tool reciprocally until the seating surfaces become lapped or hand ground to each other.

12. A reciprocating pump according to claim 1 in which;

said valve seat surface of said cylindrical seat element is a flat planar seating surface on the end of said inner wall and perpendicular to the axis of the central bore of said seat element, and said valve element is a disc-shaped member having an outside diameter slightly less than the interior diameter of said retainer member and opposed flat sides perpendicular to the valve element axis and at least one of which is configured to sealably engage the flat planar seating surface on the end of said inner wall, and said spring means comprises a coiled spring positioned concentrically within said retainer element compressibly engaging the underside of said web portion of said retainer element and the top end of said valve element to bias said valve element into closed position.

13. A fluid end adapted to form part of a reciprocating pump capable of delivering fluid at relatively high pressures in excess of 5000 psi, comprising in combination;

a stuffing box including a plunger bore and a cylindrical plunger mounted for reciprocation therein, a fluid cylinder block including a first cylindrical passage extending through said block from a first side thereof to a second side thereof and including a first cylindrical valve chamber therein, said fluid cylinder block adapted to be mounted on said stuffing box so that said first passage is in line with said plunger bore, the diameter of said first passage being substantially no greater than the diameter of said plunger bore, a first manifold block mounted against said second side of said fluid cylinder block and including a fluid passage in fluid communication with said first passage, first valve means having a reduced diameter portion slidably received in said first cylindrical valve chamber and an enlarged diameter portion captured between said first manifold and said second side of said fluid cylinder block to control the flow of fluid through said first passage from said second side of said fluid cylinder block, seal means for sealing the flow of fluid about said first valve means and said first valve chamber, and between said stuffing box, fluid cylinder block and first manifold block at a point external of said first passage, the enlarged diameter disposed external of said first passage to permit visual detection of fuel leakage of said seal means and minimize damage to the area within said fluid cylinder block subjected to fluid erosion due to the force of said fluid under pressure by-passing said seal means and said first valve means, a second cylindrical passage in said fluid cylinder block extending from an outer wall of said fluid cylinder block and in fluid communication with said first cylindrical passage, a second manifold block mounted against said outer wall of said fluid cylinder block and including a second cylindrical valve chamber in fluid communication with said second cylindrical passage, second valve means having a reduced diameter portion slidably received in said second cylindrical valve chamber of said second manifold and an enlarged diameter portion captured between said second manifold and said outer wall of said fluid cylinder block to control the flow of fluid through said second manifold block from said second passage, and second seal means for sealing the flow of fluid about said second valve means and said second valve chamber, and between said fluid cylinder block and second manifold block at a point external of said second passage, the enlarged diameter portion of said second valve means and said second seal means being disposed external of said second passage to permit visual detection of fuel leakage of said second seal means and minimize damage to the area within said fluid cylinder block subjected to fluid erosion due to the force of said fluid under pressure by-passing said second seal means and said second valve means, said first and second valve means each comprising;

a disc-shaped cylindrical seat element having a central bore therethrough and a seating surface on at least one end and a groove in at least one end surrounding said seating surface which has a cylindrical inner wall having a continuous peripheral undercut tapered angularly upward and outward relative to the groove, the exterior of the seat element having a short cylindrical sidewall and opposed end surfaces defining the enlarged diameter portion of said valve means, a generally cylindrical valve element having a seating surface configured to sealably engage said seating surface of said seat element when the valve is in a closed position, a hollow cylindrical retainer element having a circumferential flat segmented flange at one end which has a peripherally beaded portion configured to clamp removably on said inner wall surrounding said seating surface and its other end extending outwardly therefrom and substantially surrounding said seating surface, said retainer element having apertures through the sidewall providing flow passageways therethrough and an integral web portion at the extended end, said retainer element defining the reduced diameter portion of said valve means, said beaded portion tapered angularly upward and outward at substantially the same angle as the angle of said groove undercut whereby said retainer element may be releasably installed in said groove by pressing it downward until it snaps securely over the inner edge of said groove to fit into said undercut, and a coiled spring positioned between the underside of said web portion of said retainer element and said valve element and compressibly engaging said valve element to normally urge said valve element into closed position, said first seal means including a seal element positioned on the seating surface end of said first valve means seat element about said seating surface and another seal element positioned on the opposed end, said second seal means including a seal element positioned on the seating surface end of said second valve means seat element about said seating surface and another seal element positioned on the opposed end, said first valve means positioned with said retainer element slidably received in said first valve chamber at said second end of said fluid cylinder block and the seating surface of said seat element with the seal element positioned thereon sealably engaged between the surface of said seat element the outer surface of said second end and the opposed end with said seal element positioned thereon sealably engaged between the other surface of said seat element and the outer surface of said first manifold, and said second valve means positioned with said retainer element slidably received in said second valve chamber in said second manifold at said other end of said fluid cylinder block and the seating surface of said seat element with the seal element positioned thereon sealably engaged between the surface of said seat element the outer surface of said second manifold and the opposed end with said seal element positioned thereon sealably engaged between the other surface of said seat element and the outer surface of said fluid cylinder block.

14. A high pressure valve for reciprocating pumps comprising;

a disc-shaped cylindrical seat element with a central bore therethrough and a valve seat surface on at least one side and a groove in at least one side thereof surrounding said valve seat and having a cylindrical outer wall and an inner wall having a continuous peripheral tapered angularly upward and outward relative to the groove, a generally cylindrical valve element configured to close against said valve seat surface, a hollow cylindrical retainer element having a circumferential flat segmented flange at one end which has a peripherally beaded portion and a web portion partially enclosing the other end thereof, said beaded portion tapered angularly upward and outward at substantially the same angle as the angle of said groove undercut whereby said retainer element may be releasably installed in said groove by pressing it downward until it snaps securely over the inner edge of said groove to fit into said undercut, and spring means positioned between an end portion of said retainer element and said valve element to bias said valve element into closed position.

15. A high pressure valve for reciprocating pumps according to claim 14 in which each said cylindrical seat element has a groove in one side thereof surrounding said valve seat and having a cylindrical outer wall and an inner wall having a continuous peripheral undercut, said retainer element circumferential flat segmented flange having a peripherally beaded portion configured to clamp into said groove undercut on said seat element, and said retainer element has a web portion partially closing one end thereof.

16. A high pressure valve for reciprocating pumps according to claim 14 in which said retainer element has a web portion partially closing one end thereof, said spring means comprising a coiled spring positioned between the underside of said web portion of said retainer element and said valve element, said valve seat element having a groove in the side opposite said valve seat and surrounding said bore, and sealing rings being positioned in each of said grooves.

17. A high pressure valve for reciprocating pumps according to claim 16 in which said one sealing ring positioned in the groove in which said retainer element flange is positioned is disposed between the outer edge of said segmented flange and the outer wall of the groove.

18. A reciprocating pump according to claim 14 in which said disc-shaped cylindrical seat element has a valve seat surface on both sides thereof, a groove in both sides of said disc-shaped cylindrical seat element surrounding said valve seat and having a cylindrical outer wall and an inner wall having a continuous peripheral undercut, and said retainer element circumferential flat segmented flange having a peripherally beaded portion configured to clamp into said groove undercut on said seat element.

19. A high pressure valve for reciprocating pumps according to claim 14 in which said disc-shaped cylindrical seat element has a groove in one side thereof surrounding said valve seat and having a cylindrical outer wall and an inner wall having a continuous peripheral undercut, said retainer element circumferential flat segmented flange having a peripherally beaded portion configured to clamp into said groove undercut on said seat element, one sealing ring disposed in the groove in which said retainer element flange is positioned between the outer edge of said segmented flange and the outer wall of the groove, said retainer element has a web portion partially closing one end thereof, said spring means comprising a coiled spring positioned between the underside of said web portion of said retainer element and said valve element, said valve seat element having a groove in the side opposite said valve seat and surrounding said bore, and another sealing ring disposed in said groove in said seat element opposite side.

20. A high pressure valve for reciprocating pumps according to claim 14 in which said valve seat surface of said cylindrical seat element is defined by an inwardly tapered truncated conical interior seating surface at one end of said central bore,

21. A high pressure valve for reciprocating pumps according to claim 20 in which said valve element has an axially symmetrical cylindrical body portion with a conical seating surface fitting said conical interior seating surface of said seat element, said conical seating surface having one reduced diameter guide portion at one end slidable in said central bore of said seat element, and another reduced diameter portion at the other end positioned within said retainer element.

22. A high pressure valve for reciprocating pumps according to claim 21 in which said coiled spring is received about said other reduced diameter portion of said seat element to normally bias said valve element into closed position.

23. A high pressure valve for reciprocating pumps according to claim 21 in which said one reduced diameter guide portion of said seal element comprises at least three integral wing portions extending radially about the valve element axis, the outer edge of said wing portions generating a cylinder of a diameter less than the diameter of the central bore of said seat element, the space between said radial wing portions providing fluid flow paths.

24. A high pressure valve for reciprocating pumps according to claim 21 including;

a central bore through said web portion of said retainer element for insertion of a tool suitable for rotating said valve element, and a slot extending transversely across the top of said second reduced diameter portion of said valve element to receive one end the tool and transmit rotational movement of the tool to said valve element whereby the seating surfaces of said seat element and said valve element may be resurfaced without disassembly of the valve by applying abrasive material between the sealing surfaces and rotating the tool reciprocally until the seating surfaces become lapped or hand ground to each other.

25. A high pressure valve for reciprocating pumps according to claim 14 in which said valve seat surface of said cylindrical seat element is a flat planer seating surface on the end of said inner wall and perpendicular to the axis of the central bore of said seat element, and said valve element is a disc-shaped member having an outside diameter slightly less than the interior diameter of said retainer member and opposed flat sides perpendicular to the valve element axis and at least one of which is configured to sealably engage the flat planer seating surface on the end of said inner wall, and said spring means comprises a coiled spring positioned concentrically within said retainer element compressibly engaging the underside of said web portion of said retainer element and the top end of said valve element to bias said valve element into closed position.

26. A high pressure valve for reciprocating pumps comprising;

a disc-shaped cylindrical seat element having a central bore therethrough and a seating surface on at least one end, the exterior of the seat element being defined by a short cylindrical sidewall and opposed end surfaces, a cylindrical recess in the seating surface end defining a circumferential outer wall and an inwardly spaced reduced diameter raised shoulder surrounding said seating surface, a second reduced diameter portion at the opposite end defining a guide lip concentric with the axis of the central bore, and a groove in said opposite end surrounding the guide lip concentric with the axis of the central bore, the periphery of said raised shoulder of said seat element tapered angularly upward and outward relative to the recess, a generally cylindrical valve element having a seating surface configured to sealably engage said seating surface of said seat element when the valve is in a closed position, a hollow cylindrical retainer element having a circumferential flat segmented flange at one end extending radially outward perpendicular to the longitudinal retainer axis, said flange received within said cylindrical recess in said seat element and the interior diameter of said retainer releasably engaging said raised shoulder portion of said seat element and substantially surrounding said seating surface with the periphery of said flange spaced radially inwardly from the circumferential wall of said valve seat element to define a groove therebetween, said retainer element having apertures through the sidewall providing flow passageways therethrough and an integral web portion at the end opposite said flange, the lower interior diameter of said retainer element tapered angularly upward and outward at substantially the same angle as the angle of said raised shoulder but at a slightly less radial dimension to provide an interference fit therewith whereby said retainer element may be releasably installed on said raised shoulder by pressing it downward until it snaps securely over said shoulder a seal member positioned in said groove between the outer edge of said retainer element flange and said outer wall of said valve seat cylindrical recess, a seal member positioned in said groove surrounding said second reduced diameter guide lip of said valve element, and a coiled spring positioned between the underside of said web portion of said retainer element and said valve element and compressibly engaging said valve element to normally urge said valve element into closed position.

27. The valve assembly according to claim 26 in which;

said disc-shaped cylindrical seat element having a seating surface at both ends, the periphery of said second reduced diameter guide lip of said seat element is tapered angularly outward from the seat element, and the lower interior diameter of said retainer element is tapered angularly upward and outward at substantially the same angle as the angle of said guide lip but at a slightly less radial dimension to provide an interference fit therewith whereby said seat element may be inverted and said retainer element may be releasably installed on either said raised shoulder or on said guide lip by pressing it downward until it snaps securely thereover.

28. The valve assembly according to claim 26 in which;

said seating surface of said cylindrical seat element defined by an inwardly tapered truncated conical interior seating surface at at least one end of said central bore.

29. The valve assembly according to claim 28 in which;

said valve element comprises an axially symmetrical enlarged diameter cylindrical portion having a truncated conical seating surface configured to sealably engage said truncated conical interior seating surface of said seat element, said truncated conical seating surface having a first integral axial reduced diameter guide portion at one end slidably received within said central bore of said seat element, and a second integral reduced diameter portion at the other end positioned within said retainer element.

30. The valve assembly according to claim 29 including;

said coiled spring received about said second reduced diameter portion of said valve element and compressibly engaging the underside of said web portion of said retainer element and the enlarged diameter cylindrical portion of said valve element to normally urge said valve element into closed position.

31. The valve assembly according to claim 29 in which;

said first integral axial reduced diameter guide portion of said seal element comprises at least three integral wing portions extending radially about the valve element axis, the outer edge of said wing portions generating a cylinder of a diameter less than the diameter of the central bore of said seat element, the space between said radial wing portions providing fluid flow paths.

32. The valve assembly according to claim 29 including;

a central bore through said web portion of said retainer element for insertion of a tool suitable for rotating said valve element, a slot extending transversely across the top of said second reduced diameter portion of said valve element to receive one end the tool and transmit rotational movement of the tool to said valve element whereby the seating surfaces of said seat element and said valve element may be resurfaced without disassembly of the valve by applying abrasive material between the sealing surfaces and rotating the tool reciprocally until the seating surfaces become lapped or hand ground to each other.

33. The valve assembly according to claim 26 in which;

said seating surface of said cylindrical seat element defined by a flat planer seating surface on the top of said raised shoulder perpendicular to the axis of the central bore of said seat element, and said valve element is a cylindrical disc-shaped member having an outside diameter slightly less than the interior diameter of said retainer member and opposed flat ends perpendicular to the valve element axis and at least one of which is configured to sealably engage the flat planer seating surface of said raised shoulder, and said coiled spring is positioned concentrically within said retainer element compressibly engaging the underside of said web portion of said retainer element and top end of said valve element to normally urge said valve element into closed position on the top of said raised shoulder.

34. The valve assembly according to claim 33 in which;

the periphery of said seat element guide lip is tapered angularly outward from the seat element and has a second flat planer seating surface on the end surface thereof perpendicular to the axis of the central bore of said seat element whereby said seat element may be inverted and said retainer element may be releasably installed on either said raised shoulder or on said guide lip by pressing it downward until it snaps securely thereover.

* * * * *